US005508673A

United States Patent [19]

Staszewski

[11] Patent Number: 5,508,673

[45] Date of Patent: Apr. 16, 1996

[54] HIGH FREQUENCY TRANSFORMER APPARATUS

[75] Inventor: Robert B. Staszewski, Richardson, Tex.

[73] Assignee: Alcatel Network Systems, Inc., Richardson, Tex.

[21] Appl. No.: 72,311

[22] Filed: Jun. 2, 1993

[51] Int. Cl.[6] ..... H01F 27/28

[52] U.S. Cl. ..... 336/184; 336/182; 336/183; 336/69

[58] Field of Search ..... 336/69, 180, 182 M, 336/183, 184

[56] References Cited

U.S. PATENT DOCUMENTS

| | | | |
|---|---|---|---|
| 553,675 | 1/1896 | Haskins . | |
| 4,763,093 | 8/1988 | Cirkel et al. | 336/58 |

FOREIGN PATENT DOCUMENTS

| | | | |
|---|---|---|---|
| 462107 | 12/1949 | Canada | 336/183 |
| 57158 | 1/1940 | Denmark | 175/356 |
| 227506 | 10/1991 | Japan | 336/69 |

*Primary Examiner*—Leo P. Picard
*Assistant Examiner*—L. Thomas
*Attorney, Agent, or Firm*—Baker & Botts

[57] ABSTRACT

A transformer designed for 1:N voltage transformation (where 1:N may be any rational number) at high frequencies (such as over 7 megahertz) can achieve acceptable frequency response and attendant improved values of signal attenuation and signal distortion by physically separating two or more sets of electrically tightly coupled windings and connecting one winding of different sets in parallel and the other winding of the same sets in series. This interconnection of windings to achieve a 1:N transformation ratio reduces the negative effects of the interwinding capacitance thereby providing the improved frequency response.

14 Claims, 2 Drawing Sheets

HIGH FREQUENCY TRANSFORMER APPARATUS

TECHNICAL FIELD OF THE INVENTION

The present invention is generally related to transformers and more specifically related to transformers for use in high frequency signal applications where the signals involved are nominally above seven megahertz.

BACKGROUND OF THE INVENTION

At low frequencies (i.e., f≦2MHz) one can easily achieve a high magnetic coupling between windings due to a common availability of magnetic cores that feature a high magnetic permeability (i.e., μ≧R.B.S. 5000) and relatively low core losses. Since magnetic coupling determines how well the magnetic field is confined to the core, it is evident that good magnetic coupling results in less magnetic leakage and better reproduction of the signal at the secondary. As the signal frequency increases, the permeability decreases and the core losses increase thereby contributing to increased magnetic leakage. The increased magnetic leakage causes signal distortion. Further, as signal frequency increases, transformer stray parameters play increasingly significant roles in limiting good performance.

One solution to the referenced problems is to use a special high frequency core where the core losses at high frequencies are relatively low and the magnetic permeability μ is quite flat with frequency. However, the value of μ, as compared to low frequency cores, is highly reduced (μ≦1000). As a result, the use of the special high frequency transformer cores require some extra effort to compensate for the reduced magnetic coupling. One prior art solution is to place primary and secondary windings very close together by using a parallel bonded or twisted wire pair (FIG. 1). Unfortunately, by placing the windings close together, the interwinding capacitance gets large and exceeds, by many times, the winding shunt distributed capacitance. However, when the transformation ratio is 1:1 and there is no ground phase reversal, one can show that there will be almost no varying electric field between the primary and secondary. Under these circumstances, high interwinding capacitance resulting from high electrical coupling will have virtually no effect on frequency performance of the 1:1 transformer. However, even here, if one is not careful in placing grounds, the interwinding capacitance can add to the shunt capacitance and the performance advantage to be gained by the good electrical coupling is completely lost.

In view of the above, transformers with transformation ratios other than 1:1 are rarely used at high frequencies if signal distortion is of concern. Placing coacting or commonly interacting primary and secondary windings at a distance from one another on a single magnetic core to reduce the interwinding capacitance will significantly increase the magnetic leakage. Placing unbalanced windings close together will result in a highly varying interwinding electrical field. In both cases, high frequency performance will be degraded.

SUMMARY OF THE INVENTION

The solution, as presented herein, is to create two localized transformers in which windings belonging to the same localized transformer are tightly coupled electrically. Windings belonging to different localized transformers are situated to have a very weak electrical coupling (FIG. 4). A new type of 1:2 (CT) transformer is created by interconnecting the windings in such a way to virtually eliminate effect of the high electrical coupling within localized transformers on the frequency characteristics (FIG. 5).

BRIEF DESCRIPTION OF THE DRAWINGS

It is thus an object of the present invention to improve the design of a 1:N transformer for use in high frequency situations.

Other objects and advantages of the present invention will be apparent from a reading of the specification and appended claims along with the drawings wherein:

DETAILED DESCRIPTION F OF THE INVENTION

Figure 1:
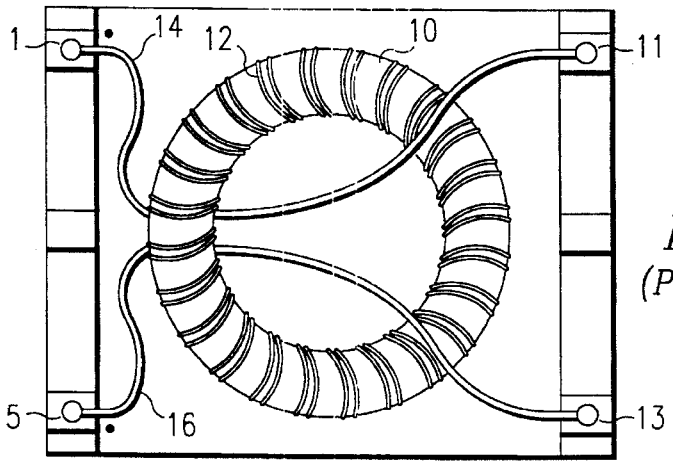
FIG. 1 (PRIOR ART)
FIG. 1 is a pictorial diagram of a prior art one-to-one transformer for use in explaining prior art problems.

In FIG. 1 a magnetic core designated as 10 contains a set of windings designated as 12 which are tightly coupled electrically. This set of windings 12 comprises individual windings 14 and 16. The windings 14 and 16 may be twisted wires or parallel bonded each of which would have good electrical coupling. In view of the illustration, it will be apparent that from a transformer design standpoint, the ends designated as 1 and 5 of wires 14 and 16 would each have a star or dot as shown. The other ends of these two windings which are connected to terminals 11 and 13 are the non-dot ends of the set of windings 12.

Figure 2:
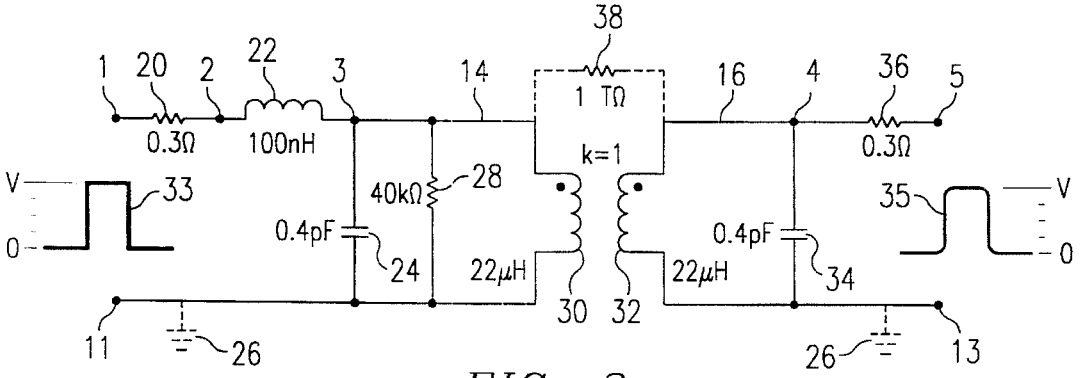
FIG. 2 is a SPICE (Simulation Program with Integrated Circuit Emphasis) equivalent of the transformer of FIG. 1 with no reversal of AC grounds polarity

In FIG. 2 an electrical representation of the apparatus of FIG. 1 is shown in the manner which would be used for computer analysis of the properties of the transformer. The example shown is a SPICE (Simulation Program with Integrated Circuit Emphasis) equivalent.

In FIG. 2 a resistor 20 is shown connected between terminal 1 and a junction point 2. Resistor 20 represents the DC series resistance of winding 30 of the transformer. An inductance 22 is shown representing the leakage inductance to air of the transformer. Inductor 22 is connected between points 2 and 3. A capacitor 24 is shown connected between point 3 and a terminal 11. Capacitor 24 represents the shunt distributed capacitance of the winding. Capacitor 24 is also the effective shunt distributed capacitance of a winding since under the ground connection conditions shown. The interwinding capacitance resulting from the high electrical coupling has no effect on the frequency performance of a 1:1 transformer. Terminal 11 is illustrated as being connected to ground 26. This ground is shown in dash line because the effective ground could be on the transformer itself or in prior circuitry. A resistor 28 is shown connected between point 3 and terminal 11. Resistor 28 represents the core losses of the transformer. The lead 14 is shown connected to one end (the star end) of a winding designated as 30 in FIG. 2 and representing one of the two wires designated as 12 in FIG. 1. The other winding is designated as 32 in FIG. 2 and it is part of lead 16. A further capacitor 34 is shown connected between a point 4 and terminal 13 and in parallel with winding 32. Capacitor 34 is equivalent to capacitor 24. A resistor 36 is shown connected between point 4 and terminal 5 and in a manner similar to resistor 20, represents the DC resistance of winding 32. As illustrated, terminal 13 is connected to a dash line ground 26 for the same reasons as discussed previously. A resistor 38 is connected between leads 14 and 16 and is also shown as a dash line connection since there needs to be some connection between the windings in order for the SPICE program to produce a valid result. Thus, resistor 38 was chosen to be one teraohm or as close to infinite impedance as possible.

Figure 3:
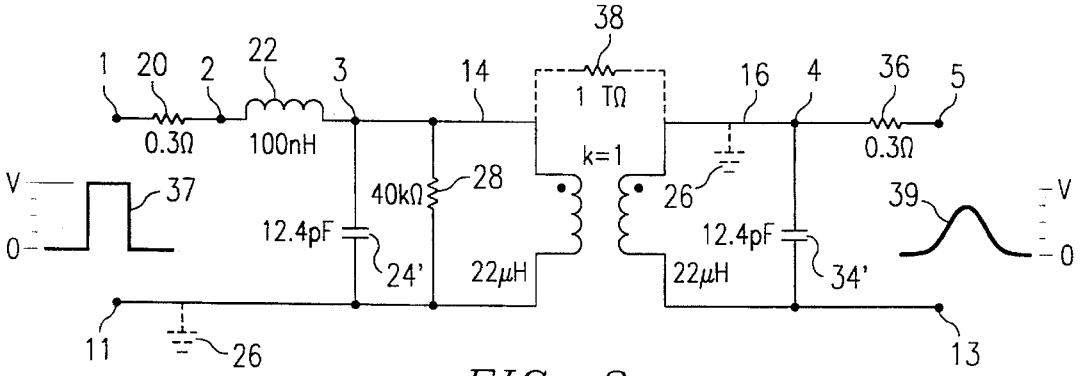
FIG.3 is a SPICE equivalent circuit of the transformer of FIG. 1 if there is a reversal of AC ground polarity.

FIG. 3 is very similar to FIG. 2 and uses the same numbers where appropriate with the main differences being that the ground 26 is connected to terminal 4 or alternately terminal 5 of FIG. 3 and due to the ground being connected to opposite relative dot ends of windings 30 and 32, the effective shunt distributed capacitance is much higher due to the effects of interwinding capacitance being added to the capacitance normally observable. Thus, the value of capacitors 24' and 34' are more than an order of magnitude greater than in FIG. 2 when there is a reversal of AC ground polarity for the transformer winding as shown in FIG. 3.

It is this reversal that prevents typically wound and interconnected center tapped transformers from operating effectively at high frequencies due to the extreme distortion of the output signals.

Figure 4:
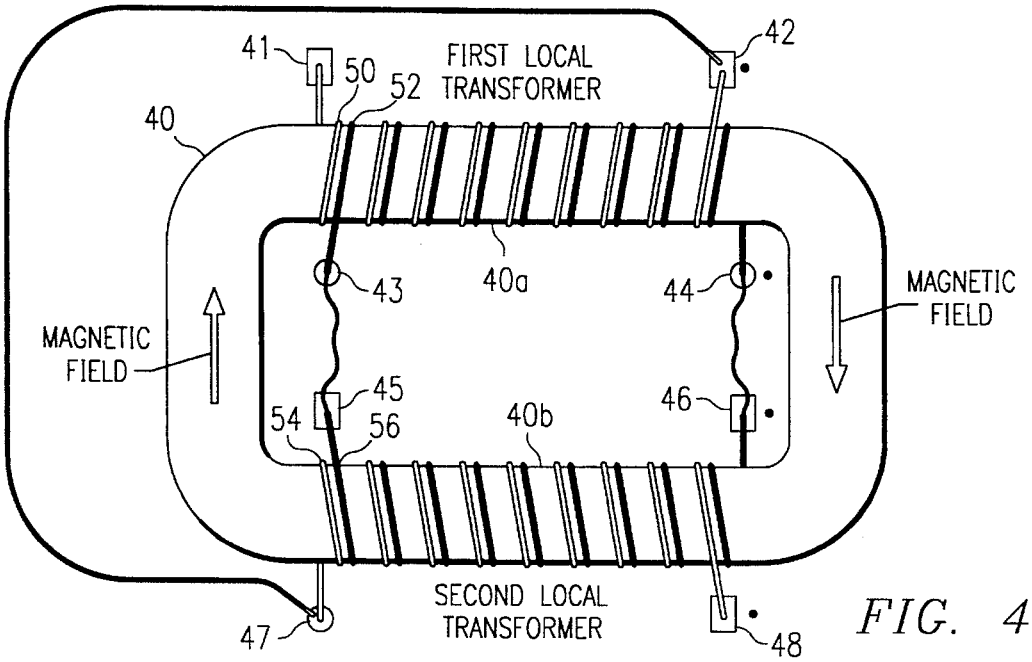
FIG. 4 illustrates a 1:2 (CT) transformer wound and interconnected in accordance with the concepts of the present invention.

In FIG. 4 a transformer having a magnetic core 40 is shown with terminals 41 through 48. A first winding 50 is shown connected between terminals 41 and 42 on first section 40*a* of magnetic core 40. A second winding 52 is shown connected between terminals 43 and 44 also on first section 40*a* of magnetic core 40. The windings 50 and 52 represent a 1:1 transformer or a first local transformer. The windings 50 and 52 in the practice of this invention may be twisted or parallel bonded to be electrically tightly coupled. A further winding 54 is wound on second section 42*b* of magnetic core 40 completely separated physically from the set of windings 50 and 52. Winding 54 is connected between terminals 47 and 48. A further winding 56 which is electrically tightly coupled with winding 54 and wound on the same portion of magnetic core is connected between terminals 45 and 46. As illustrated, terminals 43 and 45 are electrically connected together as are terminals 44 and 46. Further, terminals 47 and 42 are interconnected. The interconnections form a 1:2 center tapped transformer.

Figure 5:
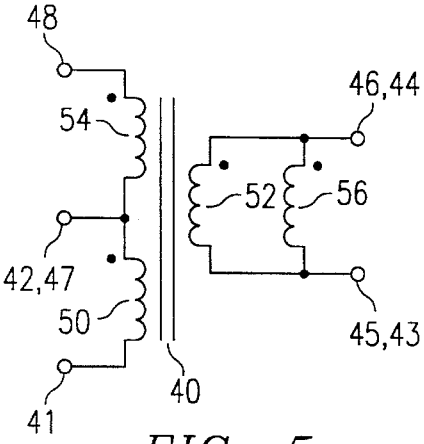
FIG. 5 an electrical equivalent of the transformer of FIG. 4.

FIG. 5 provides an electrical representation of the transformer of FIG. 4 using the same designations as used in FIG. 4.

Figure 6:
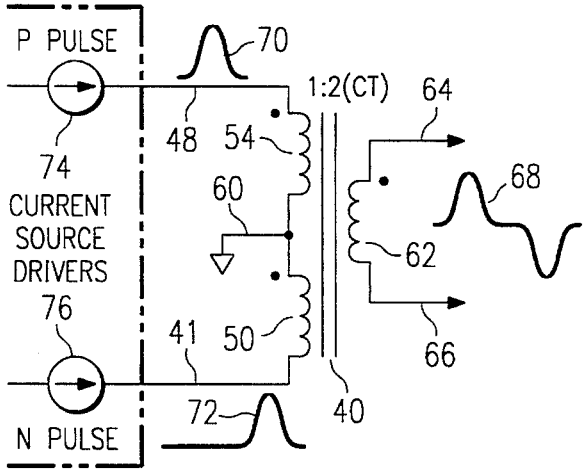
FIG. 6 is a representation of the input and output signals of the transformer of FIG. 4 when connected as a center tap transformer working as a bipolar driver.

FIG. 6 illustrates the use of the transformer of FIGS. 4 or 5 in one of several applications. As shown in FIG. 6, two current source drivers are used to provide same polarity pulses to transformer windings 54 and 50 via leads 48 and 41 respectively. These pulses are applied with respect to ground. It is assumed for FIG. 6 that windings 50 and 54 are the primary windings. For all intents and purposes, the two windings in parallel can be considered as a single winding 62 which produces a resultant output between terminals 64 and 66 of the bi-polar pulse shown as 68. The input signals are given designations 70 and 72 and are provided by current sources designated for convenience as 74 and 76, respectively.

Figure 7:
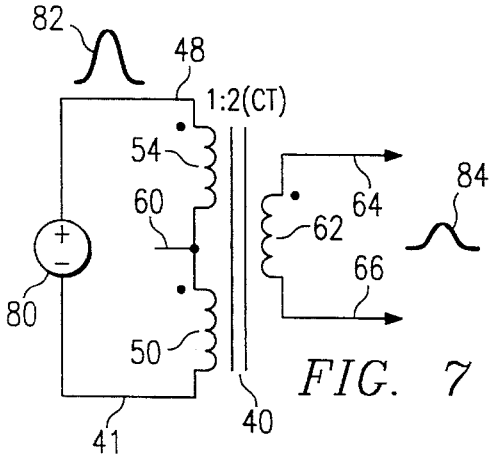
FIG. 7 is a resulting electrical schematic when the transformer of FIG. 4 is connected as a 2:1 step-down transformer.

FIG. 7 shows a single signal source 80 applying a pulse illustrated as 82 to the series connected windings 54 and 50 of the transformer with the center tap 60 not being connected to ground. In this case, a step-down transformer is obtained with a pulse 84 being obtained from secondary winding 62 between terminals 64 and 66.

Figure 8:
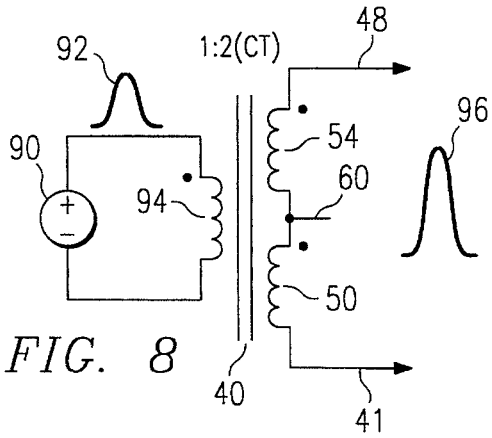
FIG. 8 is an electrical schematic of the transformer of FIG. 4 when connected as a 1:2 step-up transformer.

FIG. 8 illustrates that the transformer can be used in either direction with either the parallel or the series connected windings as the primary. Thus, FIG. 8 illustrates a further signal source 90 supplying a signal represented as 92 to the parallel windings represented as 94 and obtaining a stepped-up output from the series windings. The series windings are again designated as 54 and 50 with the stepped-up output being designated as 96. Again, the center tap 60 is not connected to ground when it is desired to obtain a step-up signal transformation.

OPERATION

Although it is believed that the operation of the present invention is reasonably obvious from the Background, Summary and Detailed Description, a brief review will be provided. The transformer of FIG. 1 is illustrated to show the prior art approach of using a core having a μ or magnetic permeability of greater than 1,000. As long as the same relative "dot" ends are connected to ground, there will be no varying electric field between windings using leads 14 and 16. Thus, a high interwinding capacitance does not substantially affect the shunt distributed capacitance as seen by either the signal source or the signal sink. As illustrated in FIG. 2, the effective shunt distributed capacitance for one embodiment of the prior art results in a value of about 0.4 picofarads. However, if the dot polarity is not observed for grounds as is shown in FIG. 3, the interwinding capacitance adds to the shunt capacitance and produces a total effective shunt distributed capacitance of 12.4 picofarads or, in other words, much more than an order of magnitude greater. The result is that the output signal will become very distorted as compared to the input signal. This is shown in FIG. 2 with the input signal being represented by 33 and the substantially undistorted output signal of 35. In FIG. 3, however, the input signal 37 becomes distorted as is illustrated by output signal 39.

FIG. 4 illustrates the present invention where the first local transformer comprising tightly coupled windings 50 and 52 are situated on one portion of transformer core 40. A second local transformer is obtained using wires 54 and 56 as a second electrically tightly coupled set of windings or local transformer. When these windings are connected as shown in FIG. 5 with one winding from each of the local transformers connected in series and the other remaining windings connected in parallel, a 1:2 center tapped transformer results. As illustrated in FIG. 6, this transformer of FIG. 5 can be used with the same polarity pulses to the leads 48 and 41, respectively, and obtain a waveform represented as 68 at the parallel winding output 62. As will be apparent, winding 62 is composed of the two windings 52 and 56 of FIG. 5.

FIG. 7 illustrates that, if lead 60 is not connected to ground and a single source 80 is used, the transformer can be used as a step-down transformer for voltage although typically a voltage step-down transformer provides an increase in output current.

FIG. 8 illustrates the opposite effect of using the two parallel windings comprising illustrated winding 94 as the primary connected to a signal source and supplying a stepped-up output voltage between leads 41 and 48 and represented by waveform 96.

While I have illustrated this concept as a 1:2 center tapped transformer, this approach of connecting one set of windings in series and the other set of windings in parallel and physically isolating each of the windings can be used to provide any 1:N transformer required. Various combination of parallel and series connected windings can be used to produce M:N signal ratios where N and M are positive whole numbers.

Although I have shown a single construction of my invention with various applications of signals as shown in FIGS. 6 through 8, I wish to be limited only by the scope of the invention as set forth in the appended claims.

What is claimed is:

1. A method for canceling the effects of interwinding capacitance on a signal nominally above one megahertz in a 1:2 center tapped transformer, the method comprising the steps of:

winding a first pair of electrically and magnetically tightly coupled wires onto a first section of a given magnetic core to create a first primary and a first secondary winding, each winding having a first end and a second end;

winding a second pair of electrically and magnetically tightly coupled wires onto a second section of said given magnetic core physically separated from said first section by a distance to minimize any electrical coupling between said first and second pair of windings and to thereby create a second primary and a second secondary winding, each winding having a first end and a second end;

connecting the first ends of said first and second secondary windings together as a first secondary transformer output lead and connecting said second ends of said first and second secondary windings together as a second secondary transformer output lead; and connecting the first end of said first primary winding and the second end of said second primary winding together.

2. Transformer A transformer apparatus comprising in combination:

magnetic core material including first and second physically separated sections;

a first pair of electrically and magnetically tightly coupled wires wound on said first physically separated section of said magnetic core material to create a first primary and a first secondary winding, each winding having a first end and a second end;

a second pair of electrically and magnetically tightly coupled wires wound on said second physically separated section of said magnetic core material to create a second primary and a second secondary winding, each winding having a first end and a second end;

first signal input means for supplying a first polarity input signal at nominally above one megahertz, said first signal input means connected to said second end of said first primary winding;

second signal input means for supplying a second polarity input signal at nominally above one megahertz, said second signal input means connected to said first end of said second primary winding;

connection means for connecting said first end of said first primary winding to said second end of said second primary winding as a center tap; and first and second output signal means connecting said first and second secondary windings in parallel with said first ends of said first and second secondary windings commonly connected to provide said first output signal means and said second ends of said first and second secondary windings commonly connected to provide said second output signal means.

3. A method for minimizing the effective shunt capacitance due to the interwinding capacitance on a signal nominally above one megahertz between primary and secondary windings in a 1:2 transformer, the method comprising the steps of:

physically separating first and second sets of electrically and magnetically tightly coupled 1:1 ratio electrical conductors enclosing portions of and in contact with a single magnetic core to minimize electrical coupling between sets of conductors, each of the first and second sets comprising A & B windings of substantially the same electrical length and each of said A & B windings having first and second ends;

electrically connecting the B windings of said first and second sets in parallel for providing an output signal nominally above one megahertz; and electrically connecting said A windings in series for receiving an input signal nominally above one megahertz.

4. The method of claim 3 further comprising the additional steps of:

connecting the first ends of said B windings of said first and second sets together; and connecting the first end of the A winding of said first set to the second end of the A winding of said second set.

5. A transformer apparatus comprising in combination:

a magnetic core material including first and second physically separated sections;

a first pair of electrically and magnetically tightly coupled wires wound on said first physically separated section of said magnetic core material to create a first primary and a first secondary winding each having a first end and a second end;

a second pair of electrically and magnetically tightly coupled wires wound on said second physically separated section of said magnetic core material to create a second primary and a second secondary winding each having a first end and each having a second end, the separation acting to minimize electrical coupling between said first and second pair of wires;

connection means for providing a series connection of said first and second primary windings; and further connecting means for connecting said first and second secondary windings in parallel with said first ends of said secondary windings commonly connected to provide a first output signal means and said second ends of said secondary windings commonly connected to provide a second output signal means; and wherein the series connection of said primary windings and the parallel connection of said secondary windings reduces the effective distributed shunt capacitance between said first and second pair of windings.

6. A transformer apparatus comprising in combination:

a magnetic core including first and second physically separated sections;

a first pair of electrically and magnetically tightly coupled wires A and B wound on said first physically separated section of said magnetic core material to create a first set of windings each winding A and B having a first end and a second end;

a second pair of electrically and magnetically tightly coupled wires C and D wound on said second physically separated section of said magnetic core material to create a second primary and a second secondary winding each winding C and D having a first end and a second end, the separation acting to minimize electrical coupling between said first and second pair of windings;

connection means for providing a series connection of said A and C windings; and further connection means for connecting said B and D windings in parallel, either one of the series or parallel windings being usable as a primary winding with the other being the secondary winding; and wherein the series connection of said A and C windings and the parallel connection of said B and D windings reduces the effective distributed shunt capacitance between said first and second pair of windings.

7. The method of claim 1 wherein said winding steps further comprises parallel bonding the wires of each pair to one another.

8. The method of claim 1 wherein the first and second pair of electrically and magnetically coupled wires are twisted wires.

9. The apparatus of claim 2 wherein each of said first and second pair of electrically and magnetically tightly coupled wires further comprises parallel bonded wires.

10. The apparatus of claim 2 wherein each of said first and second pair of electrically and magnetically tightly coupled wires further comprises a twisted pair of wires.

11. The apparatus of claim 5 wherein each of said first and second pair of electrically and magnetically tightly coupled wires further comprises parallel bonded wires.

12. The apparatus of claim 5 wherein each of said first and second pair of electrically and magnetically tightly coupled wires further comprises a twisted pair of wires.

13. The apparatus of claim 6 wherein each of said first and second pair of electrically and magnetically tightly coupled wires further comprises parallel bonded wires.

14. The apparatus of claim 6 wherein each of said first and second pair of electrically and magnetically tightly coupled wires further comprises a twisted pair of wires.

* * * * *